US009308548B2

(12) United States Patent
Troudt

(10) Patent No.: US 9,308,548 B2
(45) Date of Patent: Apr. 12, 2016

(54) UNIVERSAL PAINT APPLICATOR

(71) Applicant: Kevin Troudt, Seattle, WA (US)

(72) Inventor: Kevin Troudt, Seattle, WA (US)

(73) Assignee: True Progression LLC, Portland, OR (US)

( * ) Notice: Subject to any disclaimer, the term of this patent is extended or adjusted under 35 U.S.C. 154(b) by 0 days.

(21) Appl. No.: 14/093,686

(22) Filed: Dec. 2, 2013

(65) Prior Publication Data

US 2014/0304934 A1 Oct. 16, 2014

Related U.S. Application Data

(60) Provisional application No. 61/732,914, filed on Dec. 3, 2012.

(51) Int. Cl.
*B05C 17/02* (2006.01)

(52) U.S. Cl.
CPC ..... *B05C 17/0217* (2013.01)

(58) Field of Classification Search
CPC .. B05C 17/02; B05C 17/0205; B05C 17/0217
USPC ..... 15/230.11
See application file for complete search history.

(56) References Cited

U.S. PATENT DOCUMENTS 7,779,503 B2 * 8/2010 Dale et al. ..... 15/230.11
7,827,651 B2 * 11/2010 Graham et al. ..... 15/230.11

FOREIGN PATENT DOCUMENTS

SU 1391731 A1 * 4/1988 ..... B05C 17/02

* cited by examiner

*Primary Examiner* — Laura C Guidotti
(74) *Attorney, Agent, or Firm* — Louis J. Franco; Law Office of Louis J. Franco

(57) ABSTRACT

A paint applicator configured for use in combination with a hollow-core paint roller cover includes a handle and a pair of pivot arms extending therefrom. Each pivot arm includes a proximate end rotatably mounted to the handle and an opposite, distal end to which is pivotably mounted a hub assembly. A pivot arm actuator is cooperatively linked to the pivot arms such that movement of the actuator in a first direction causes the pivot arms to rotate toward one another and movement of the actuator in a second direction causes the pivot arms to rotate away from one another. Each hub assembly includes a rotatable hub with an outer surface configured to frictionally engage the inside surface of the roller cover such that, when the pivot arms are rotated toward one another, the hubs enter and retain the roller between the pivot arms.

3 Claims, 10 Drawing Sheets

UNIVERSAL PAINT APPLICATOR

PROVISIONAL PRIORITY CLAIM

Priority based on Provisional Application Ser. No. 61/732,914 filed Dec. 3, 2012, and entitled "UNIVERSAL PAINT APPLICATOR AND GRIPPING TRAY" is claimed. Moreover, the entirety of the previous provisional application, including the drawings, is incorporated herein by reference as if set forth fully in the present application.

BACKGROUND

Although not so limited is utility or scope, embodiments of the present invention relate generally to paint applicators and, more particularly, to paint roller systems or roller-type applicators that employ a roller cover including a cylindrical tubular roller core with an inside surface and an outside surface with a nap or pile of absorbent material configured to alternatively absorb and distribute paint.

Decorative painting of surfaces such as walls and ceilings with a roller-type applicator can be challenging and messy. Even professional painters are continually confronted with time-intensive preparation techniques, difficult-to-reach locations, lengthy take-down and cleanup routines, and awkward painting tools. Novice painters face even more daunting challenges when undertaking a home improvement painting project because they are not familiar with best painting practices or tools. Generally, paint is difficult to remove from carpets, drapery, clothing, and the like. If done improperly, a painting project can quickly spiral into something undesirable.

Conventional roller-type paint applicators cause "fat edge" to accumulate along the edges of the roller because of an imbalance of pressure caused by the general hook-shape of a paint roller applicator in which the roller cover is support for rotation from only one side. Additionally, it is difficult and unpleasant to change a wet paint roller cover with a replacement roller cover because the painter frequently comes in contact with wet paint and spreads it to clothes, floors, or other nearby items. Moreover, conventional paint trays are inconvenient to grasp and move from one location to another without spilling the paint or causing the paint to splash.

Accordingly, there exists a general need for improved apparatus and associated methods for applying paint with roller covers and, more particularly, for a universal roller-type paint applicator that (i) can accommodate roller covers of different lengths, (ii) facilitates rapid, tidy and hands-free changing of roller covers and (iii) facilitates the application of more balanced force to each end of a roller cover during application in order to avoid "fat edge," which is a term employed by some painters to indicate the undesired, uneven accumulation of paint on one side of the roller resulting in uneven application.

SUMMARY

In an illustrative embodiment, a universal paint applicator is configured for use in combination with a roller cover including a cylindrical roller-cover core with an inside surface and an outside surface carrying an absorbent material for alternatively absorbing and depositing paint on a surface. The applicator includes a handle assembly (alternatively referred to as a "handle") that extends longitudinally along a handle axis. Carried by, and extending forwardly of, the handle are first and second pivot arm assemblies which, as further explained below, are configured for the cooperative retention and release of a roller cover.

Each pivot arm assembly includes a pivot arm having a proximate end by which it depends from the handle assembly for rotation about a pivot arm axis and a distal end located opposite the proximate end and disposed forwardly of the handle assembly. A bi-directional pivot arm actuator is carried by the handle and cooperatively linked to each pivot arm assembly such that movement of the actuator in a first direction causes the pivot arms to rotate toward one another and movement of the actuator in a second direction, opposite the first direction, causes the pivot arm assemblies to rotate away from one another. In a typical version, the pivot arm assemblies, while extending forwardly of the handle, are disposed with general symmetry about the handle axis which, it is to be understood, is an imaginary line of infinite length extending through the handle.

Coupled to the distal end of each of the first and second pivot arms is a hub assembly. Each hub assembly is pivotably coupled to its respective pivot arm for angular movement, relative to that pivot arm, about a hub-pivot axis. In various versions, the degree of angular hub movement is limited by design to be within a predetermined angular range so as to facilitate proper hub alignment for "capturing" a roller cover between the hubs, an aspect that will be more fully appreciated upon further examination of the specification. Additionally, the hubs of some versions include hub caps that are tapered or conical in order to guide and align each hub into the roller-cover core as the inwardly-facing hubs are drawn toward one another.

Each hub assembly includes a hub axle and a hub mounted for rotation on the hub axle about a hub-rotation axis defined by the hub axle. The hub includes an outer surface configured to frictionally engage the inside surface of the roller-cover core such that the hubs of the first and second pivot arms cooperate to retain the roller cover between the pivot arms. Moreover, the hub-rotation axes, hub-pivot axes and pivot arm axes are movable into disparate mutual orientations such that, when the pivot arms are mutually spread to various degrees, the hub-rotation axes can be aligned to define a common roller-cover rotation axis so that the roller cover cooperatively retained by the hubs can be of any length between a predetermined minimum length and a pre-determined maximum length.

In one alternative configuration, bi-directional pivot arm actuation is facilitated in part by the inclusion at the proximate end of each pivot arm of a pivot arm gear having pivot-gear teeth. The pivot arm actuator comprises a worm-drive shaft carrying a worm gear with teeth that intermesh with the pivot-gear teeth of each pivot arm. Thusly assembled, that rotation of the worm-drive shaft in a first direction causes the pivot arms to rotate about their pivot arm axes inwardly toward one another, while rotation of the worm-drive shaft in a second direction opposite the first direction causes the pivot arms to mutually spread apart in an outwardly direction. The inward (i.e., toward "clamping") and outward (i.e., spreading) motion of the pivot arms facilitate, respectively, engagement and disengagement of the outer surfaces of the hubs with the inside surface of the roller-cover core.

In another illustrative configuration, the worm-drive shaft and worm gear are omitted. Instead, the pivot-gear teeth of the first pivot arm assembly are directly intermeshed with the pivot-gear teeth of the second pivot arm assembly such that the rotation of one of the pivot arms in one of an inwardly and outwardly direction causes the rotation of the other pivot arm in, respectively, an inwardly and outwardly direction with respect to the handle axis. Accordingly, in this configuration, each pivot arm thereby serves as the bi-directional pivot arm actuator for the other pivot arm.

Representative embodiments are more completely described and depicted in the following detailed description and the accompanying drawings.

DETAILED DESCRIPTION

The following description of variously embodied universal paint applicators is demonstrative in nature and is not intended to limit the invention or its application of uses. Accordingly, the various implementations, aspects, versions and embodiments described in the summary and detailed description are in the nature of non-limiting examples falling within the scope of the appended claims and do not serve to define the maximum scope of the claims.

Figure 1:
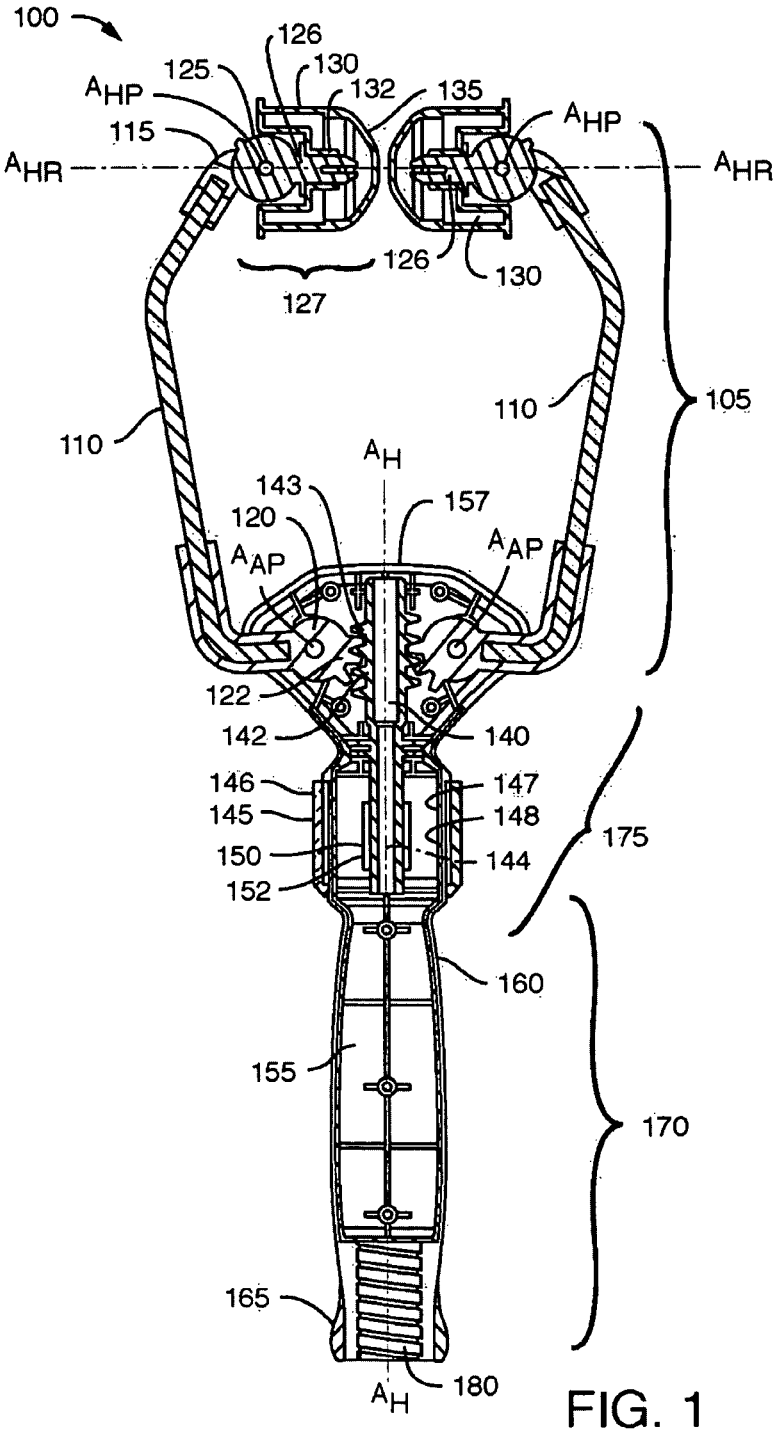
FIG. 1 is a cross-sectional/"transparent" view of an illustrative universal paint applicator.
Figure 2:
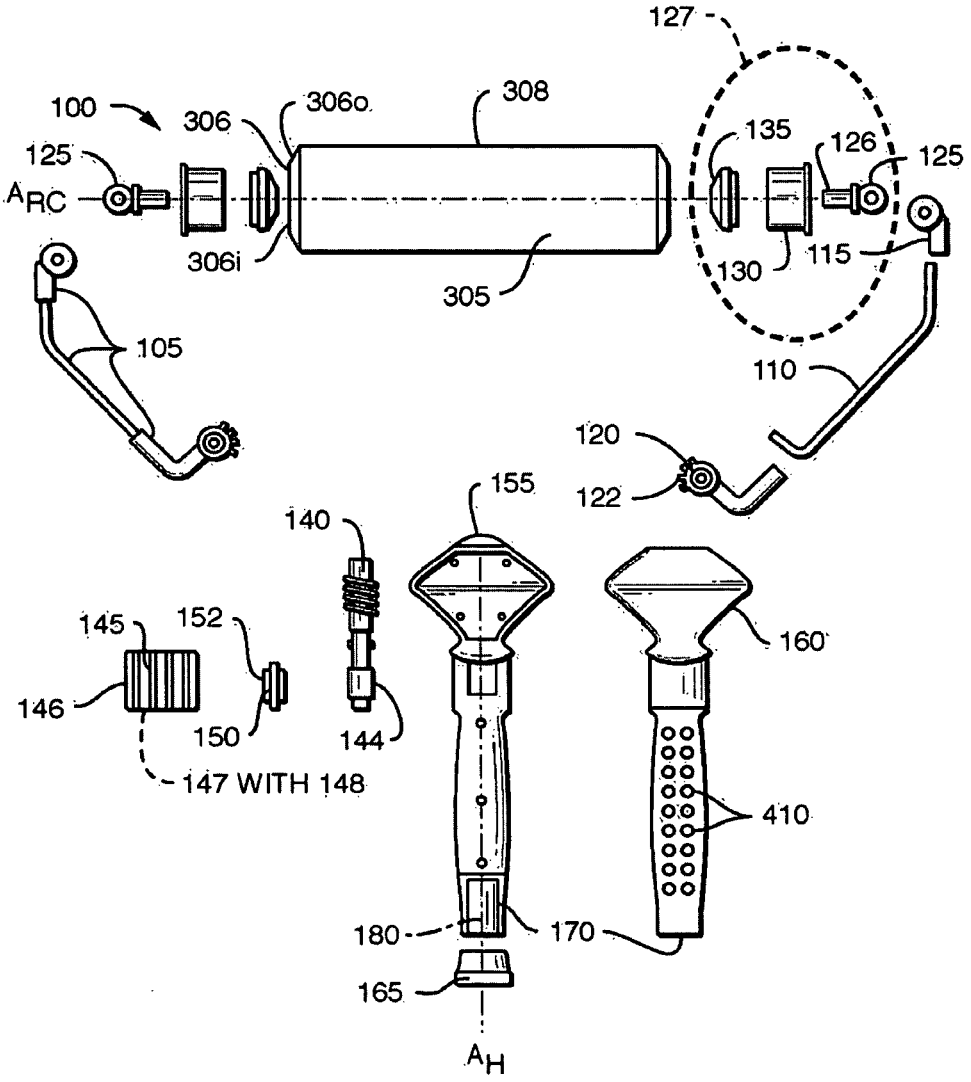
FIG. 2 is an exploded view of the universal paint applicator of FIG. 1.
Figure 3:
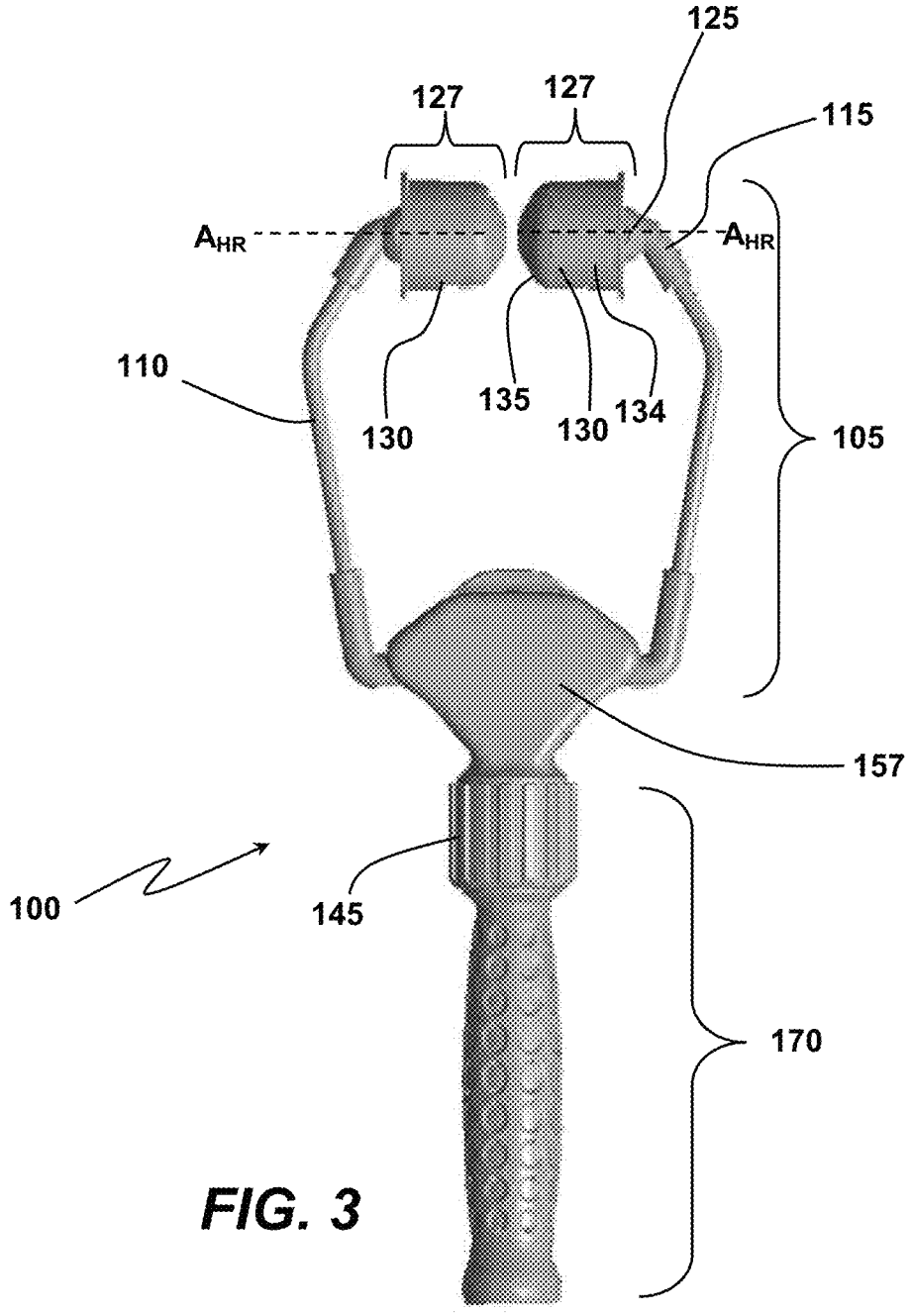
FIG. 3 is an exterior assembled view of the universal paint applicator of FIGS. 1 and 2.

With initial reference to the cross-sectional/"transparent" view of FIG. 1, the exploded view of FIG. 2 and the exterior assembled view of FIG. 3, an illustrative embodiment of a universal paint applicator 100 features a dual pivot arm configuration that, among other advantages, provides shock-absorption and force balancing that facilitate even paint application. More specifically, the paint applicator 100 includes a pair of pivot arm assemblies 105 comprising first and second pivot arm assemblies 105 that are not individually identified as such because their individual identification as "first" and "second" is arbitrary. The pivot arm assemblies 105 are carried by, and extend forwardly of, a handle assembly 170 that extends longitudinally along a handle axis $A_H$ about which handle axis $A_H$ the pivot arm assemblies 105 are disposed symmetrically. The pivot arm assemblies 105 cooperatively function as a spring when pressure is applied to the handle assembly 170 during painting. That is, as force is applied to the handle assembly 170 during painting, the pivot arm assemblies 105 flex and deflect in an outwardly direction, thereby providing a shock-absorbing feature, as further described below.

Each pivot arm assembly 105 includes a pivot arm 110, a pivot axle base 115, and a pivot arm gear 120. Because the pivot arm gear 120 of each pivot arm assembly 105 is more proximate the handle assembly 170 than is the pivot axle base 115, the opposed ends of each pivot arm 110 coupled to the pivot arm gear 120 and the pivot axle base 115 may alternatively be referred to as, respectively, the proximate and distal ends of that pivot arm 110.

With initial reference to either or both of FIGS. 1 and 2, a hub assembly 127 is pivotably coupled to each pivot axle base 115 for angular movement (i.e., rotation or pivoting) about a hub-pivot axis $A_{HP}$. In the illustrative embodiment of FIG. 1, the hub-pivot axes $A_{HP}$ are shown as extending through and perpendicularly to the plane of the drawing sheet, as well as orthogonally to the handle axis $A_H$. Each hub assembly 127 includes a pivot axle 125, a hub 130 and a hub cap 135. The pivot axle 125 by which the hub assembly 127 is pivotably mounted to the pivot axle base 115 of the pivot arm assembly 105 has extending therefrom a hub axle 126 on which the hub 130 is mounted for rotation about a hub-rotation axis $A_{HR}$. More specifically, as shown in FIG. 1, an illustrative hub 130 has a cylindrical central channel 132 extending therethrough that is configured to receive, and be retained for rotation by, the hub axle 126.

Figure 4:
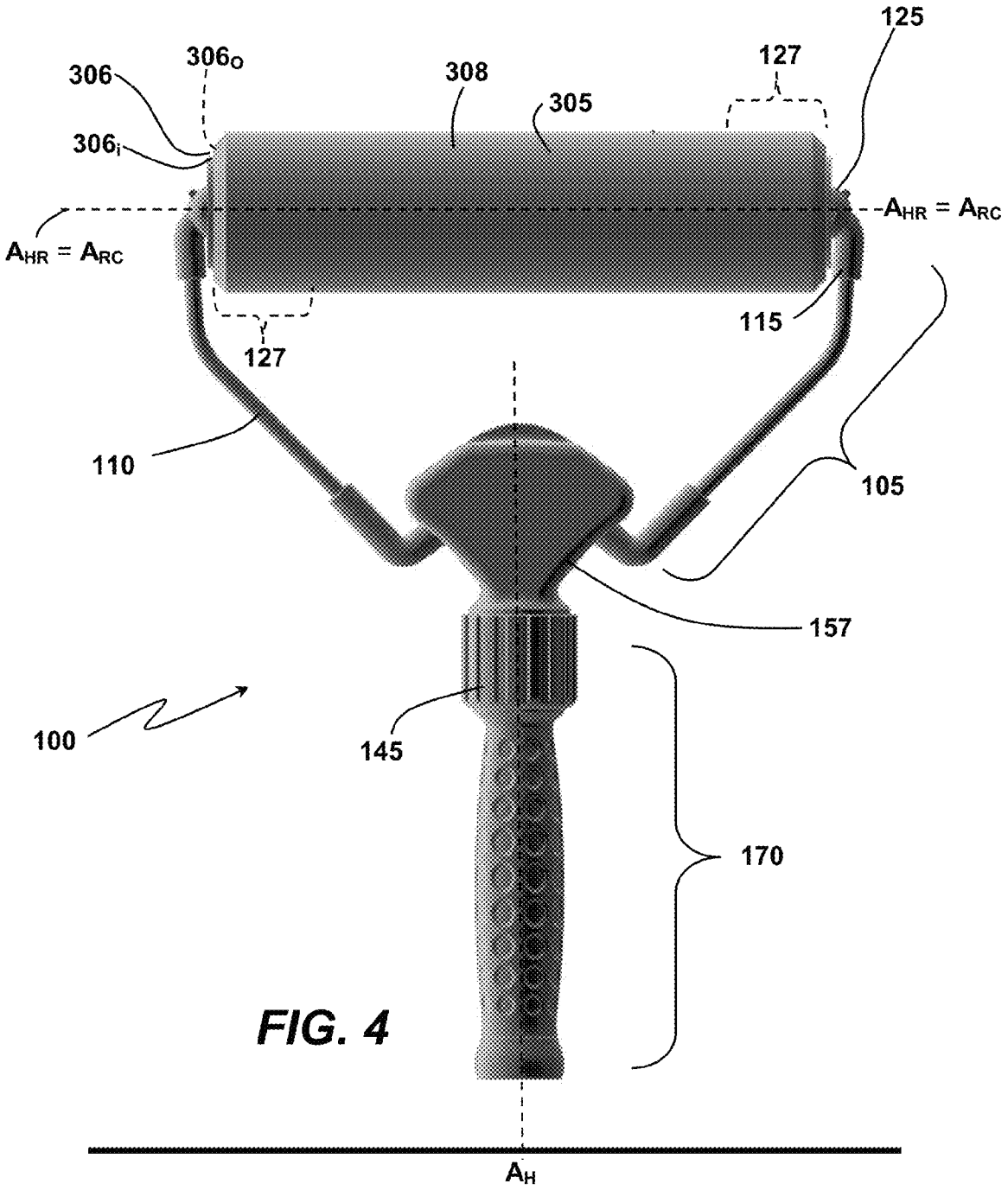
FIG. 4 depicts an illustrative universal paint applicator retaining for rotation between a pair of pivot arms a cylindrical roller cover of predetermined length.
Figure 5:
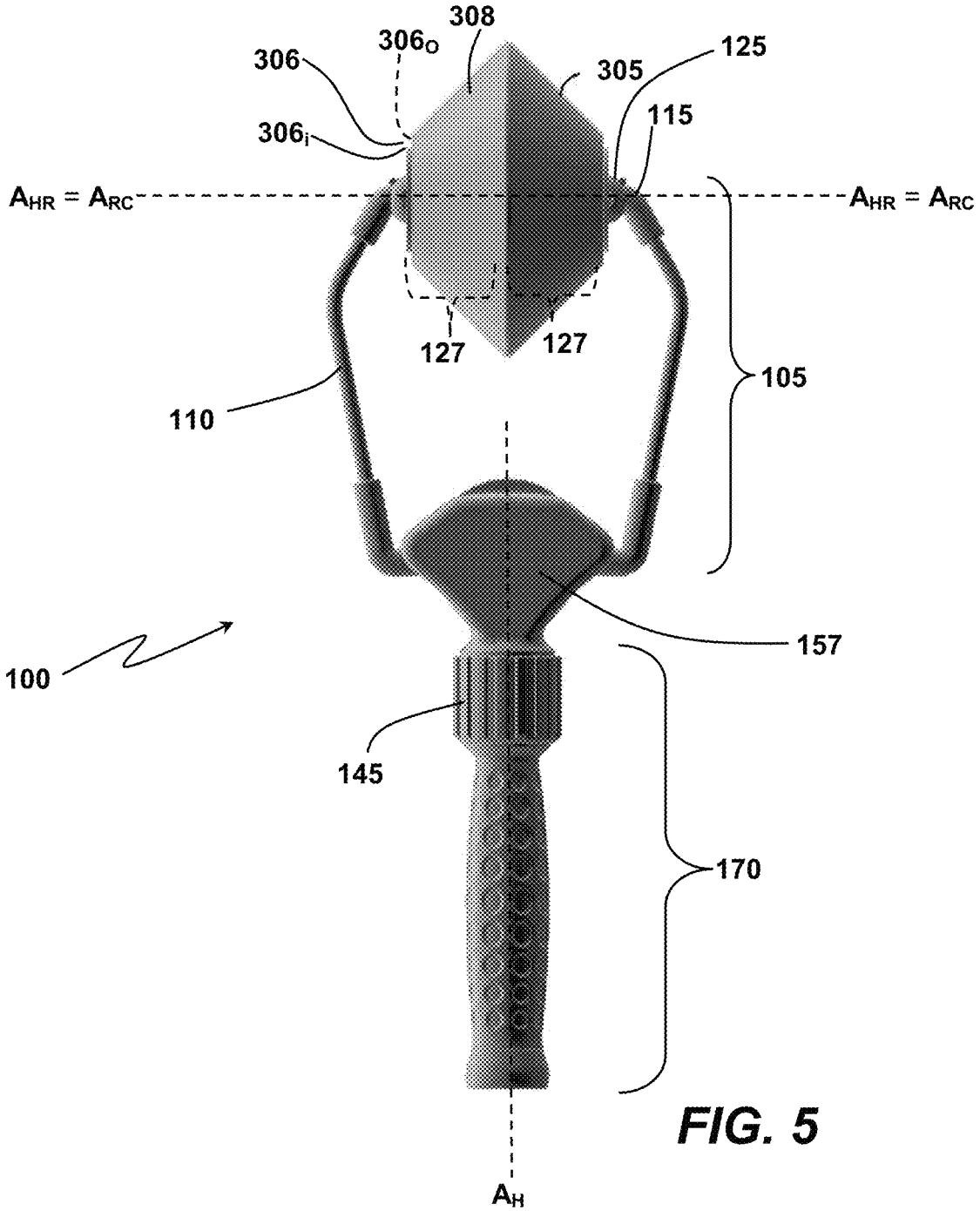
FIG. 5 shows the paint applicator of FIG. 4 retaining a roller cover of lesser length than the roller cover of FIG. 4, and the pivot arms drawn commensurately closer together.

As shown, for example, in FIGS. 2, 4 and 5, the opposed hubs 130 carried by the pivot arms 110 cooperate to engage and retain a cylindrical paint applicator which, for purposes of the present description and claims, is in the form of a roller cover 305. A typical roller cover 305 includes a cylindrical tubular roller-cover core 306 with inside and outside surfaces $\mathbf{306}_i$ and $\mathbf{306}_o$ and a nap 308 (or pile) of absorbent material carried by the outside surface 306*o* and configured to alternatively absorb paint from a paint source (not shown) and deposit that paint on a surface (not shown). Each hub 130 includes a cylindrical outer surface 134 configured to frictionally engage the inside surface 306*i* of the roller-cover core 306, and retain the roller cover 305 between the pivot arms 110.

The pivotability of the pivot arms 110 and the hub assemblies 127 with respect to the pivot arms 110 permit the hub-rotation axes $A_{HR}$ defined by the hub axles 126 to align along a common (i.e., "single" or "shared") roller-cover rotation axis $A_{RC}$ for roller covers 305 of various widths. In fact, the disparate roller lengths that can be accommodated by any given embodiment is theoretically infinite between some minimum and maximum widths corresponding to, respectively, contact between the hubs 130 and the maximum spread of the pivot arms 110. Moreover, as illustrated by comparison of FIGS. 4 and 5, roller covers 305 having disparately configured naps 308 can also be accommodated; FIG. 4 depicts a conventional cylindrical roller cover 305, while the roller cover 305 of FIG. 5 is configured for painting a corner defined by the intersection of two planar surfaces such as two walls or a wall and a ceiling (not shown).

Figure 7:
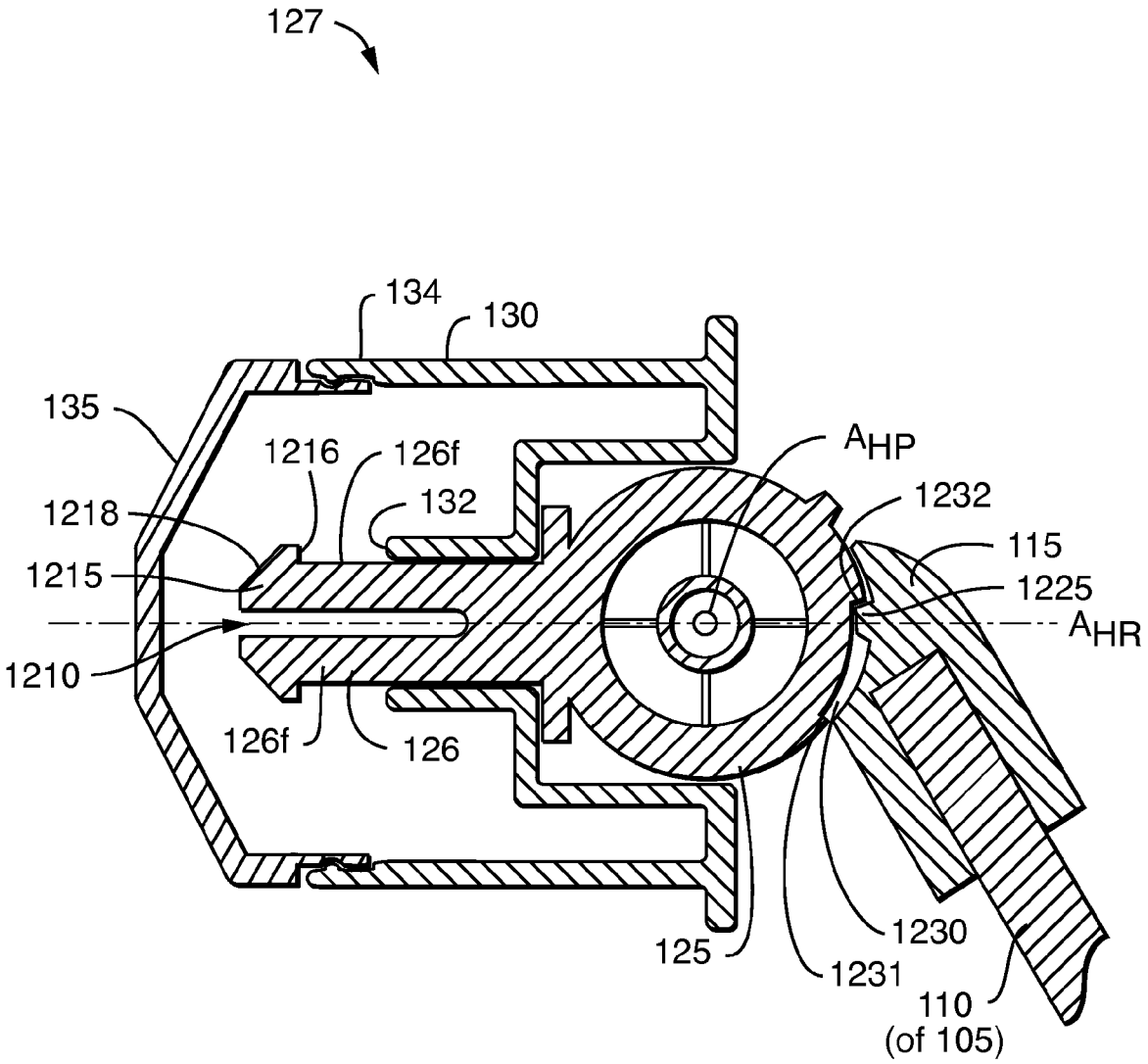
FIG. 7 is a cross-sectional detail of an illustrative hub assembly.

Although in the version of FIG. 1 the central channel 132 and hub axle 126 are of relative sizes (i.e., axial lengths) that permit little, in any, lineal (axial) displacement of the hub 130 along the hub-rotation axis $A_{HR}$ defined by the hub axle 126, embodiments are envisioned in which the hub axle 126 is longer than the central channel 132 of the hub 130 such that the hub 130 is capable of lineal displacement along the hub axle 126. One such embodiment is shown in FIG. 7, which will be described in some detail later in this description. Presently, it is sufficient to note that lineal displacement of the hub 130 along the hub axle 126 allows the pivot arms 110 of alternative versions to flex outwardly while retaining a roller cover 305 without forcing the hubs 130 out of the roller-cover core 306. Allowing the pivot arms 110 to flex provides the aforementioned shock absorption and helps to balance forces applied to the roller cover 305 for more even application of paint.

As described with initial and principal reference to FIG. 1, the paint applicator 100 includes an applicator housing 157 that is attached to the handle assembly 170 and to which each pivot arm 110 is mounted for rotation about an arm-pivot axis $A_{AP}$. As seen in the version of FIG. 1, the arm-pivot axes $A_{AP}$ extend orthogonally to the handle axis $A_H$ and, at least in the case shown, parallel with the hub-pivot axes $A_{HP}$ in order to achieve the movements hereinabove and hereinbelow described. The housing 157 encloses a gear assembly 175. Pivot-gear teeth 122 on the pivot arm gear 120 of each pivot arm assembly 105 intermesh with the teeth 143 of a worm gear 142 carried by worm-drive shaft 140. Thusly assembled, rotation of the worm-drive shaft 140 in a first direction causes the pivot arm assemblies 105 to simultaneously clamp together in an inwardly direction to secure a roller cover 305 between the hubs 130. Conversely, rotation of the worm-drive shaft 140 in a second direction opposite the first direction causes the pivot arms 110 to mutually spread outwardly in symmetric fashion and either (i) release a roller cover 305 retained thereby or (ii) allow for installation of a new roller cover 305. In other words, the pivot arm assemblies 105 are configured to simultaneously rotate in opposite directions relative to the housing 157. Thus, the roller cover 305 can be secured to and released from the universal paint applicator 100 in a "hands free" manner, thereby facilitating simple, quick and less messy changing of roller covers 305.

As in the embodiment of FIGS. 1 and 2, the worm-drive shaft 140 is typically enclosed within the applicator housing 157. In order to facilitate a user's rotation of the worm-drive shaft 140 from the exterior of the housing, the applicator 100 of FIG. 1 illustratively includes a ring gear 145 disposed coaxially with the worm-drive shaft 140 and having an annular exterior surface 146 that is at least partially accessible from the exterior of the applicator housing 157. In the version of FIGS. 1, 2 and 3, the ring gear 145 is essentially a collar with the exterior surface 146 annularly disposed about a portion of the handle assembly 170. An interior surface 147 of the ring gear 145 carries internal ring-gear teeth 148, the purpose of which will be subsequently described.

With continued reference to FIG. 1, but especially the exploded view of FIG. 2, when assembled, a planet gear 150 is disposed between the interior surface 147 of the ring gear 145 and the portion of the cylindrical outer surface of the worm-drive shaft 140. The planet gear 150 has external planet-gear teeth 152 that intermesh with the internal ring-gear teeth 148. Moreover, the worm-drive shaft 140 carries external drive-shaft teeth 144 that intermesh with the external planet-gear teeth 152. It will be readily appreciated by a person of ordinary skill in the relevant art, and a person with general mechanical knowledge, that, when the aforesaid components are thusly assembled, rotation of the ring gear 145 causes rotation of the planet gear 150 and, in turn, rotation of the worm-drive shaft 140 by the rotating planet gear 150, thereby causing the pivot arm assemblies 105 to pivot toward or away from one another to retain or release a roller cover 305.

Figure 6:
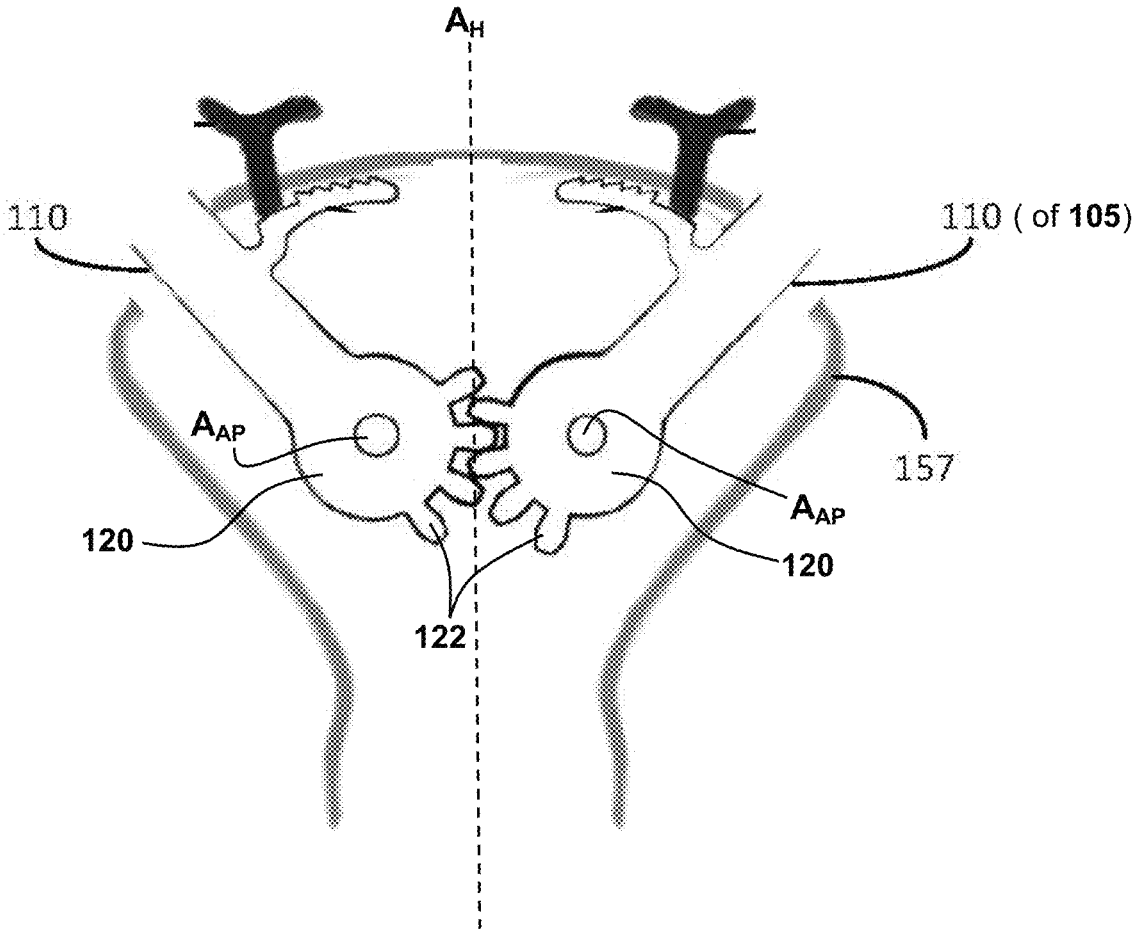
FIG. 6 depicts the intermeshing of the pivot-gear teeth of alternatively configured roller-retaining pivot arms.

With reference now to FIG. 6, in which components relevant to the present discussion are isolated, illustrative alternative mechanics for actuating the pivot arms 110 toward and away from one another are shown and described. In the version of FIG. 6, in which "like components" relative to alternative versions are identified by "like reference characters," the pivot-gear teeth 122 of the first pivot arm assembly 105 are directly intermeshed with the pivot-gear teeth 122 of the second pivot arm assembly 105, wherein, again, the identification of the assemblies 105 as "first" and "second" is purely arbitrary. Thusly configured, the rotation of one of the pivot arms 110 in an inwardly direction, relative to the handle axis $A_H$, causes the other pivot arm 110 to rotate inwardly such that the pivot arms 110 are drawn more closely together. Conversely, the rotation of one of the pivot arms 110 in an outwardly direction, relative to the handle axis $A_H$, causes the other pivot arm 110 to rotate outwardly such that the pivot arms 110 are spread farther apart. Accordingly, while in the illustrative embodiment in which a worm-drive shaft 140 and associated components serve as a bi-directional pivot arm actuator, in the version presently under discussion, each pivot arm 110 serves as the bi-directional pivot arm actuator for the other pivot arm 110.

Although the construction of the handle assembly 170 is of no particular consequence, FIG. 2 depicts an embodiment in which the handle assembly 170 includes first and second handle members 155 and 160 which are selectively held together in part by a retaining ring 165. Exterior surfaces of the handle members 155 and 160 may include undulations such as, by way of non-limiting example, indentations 410 (of FIG. 3) in order to facilitate gripping. The indentations 410 may be circular, elliptical, oval or of any other advantageous configuration. Internal threads 180 disposed within a bottom portion of the handle assembly 170 can receive an extension pole or rod (not shown) so that the universal paint applicator 100 can be extended to reach high regions of a wall or a ceiling, for example.

Referring to FIG. 7, the details of an illustrative hub assembly 127 are now revisited. As previously described, a hub assembly 127 includes a pivot axle 125, a hub 130 and a hub cap 135. The hub cap 135 is tapered in order to facilitate insertion into a roller-cover core 306, as described in the summary.

In order to facilitate retention and removal of the hub 130 from the hub axle 126, the hub axle 126 is split to define at least one slot 1210 extending along the hub-rotation axis $A_{HR}$. More specifically, by virtue of the slot 1210, the hub axle 126 includes at least two axle fingers **126*f* extending in parallel along the hub-rotation axis $A_{HR}$. Each finger 126*f* terminates in a hub retainer 1215 that has a flanged catch 1216 and a sloped surface 1218 that angles toward the hub-rotation axis $A_{HR}$ in a direction moving away from the pivot axle 125 from which the hub axle 126 depends. The fingers 126*f* can be temporarily flexed toward one another to allow a hub 130 to be mounted over, and retained by, the hub axle 126. More specifically, the hub retainers 1215 are configured to extend wider than the diameter of the central channel 132 in the hub 130 such that, as the sloped surfaces 1218 of the hub retainers 1215 are urged into the central channel 132, the fingers 126*f* flex inwardly and that the fingers 126*f* and hub retainers 1215 can pass through the central channel 132. Once the hub retainers 1215 emerge from the other side of the central channel 132, the fingers 126*f* spread back out to their non-flexed attitudes, and the hub 130 is axially retained by the flanged catches 1216. To remove the hub 130, the fingers 126*f* are flexed inwardly so that the hub retainers 1215 can pass back out through the central channel 132**.

As indicated in the summary relative to some embodiments, the extent of angular movement between the hub assembly 127 and the pivot arm 110 to which the hub assembly 127 is coupled is intentionally limited. More specifically, it is advantageous for the hubs 130 to be facing generally inwardly toward the handle axis $A_H$, but to have some degree of angular movement in order to facilitate "capture" of a roller cover 305, as well as the retention of roller covers 305 of various lengths. To this end, illustratively configured components are shown in FIG. 7 in which the pivot axle 125 has defined therein an arcuate slot 1230 (or "race") centered on the hub-pivot axis $A_{HP}$ and defined by first and second slot ends 1231 and 1232. Protruding from the pivot axle base 115, and into the slot 1230, is a pivot stop 1225 that defines the extremes of angular motion for the hub assembly 127 in each direction by abutting engagement with, alternatively, the first and second slot ends 1231 and 1232. The degree of angular freedom—or range of pivot or rotation—in such an embodiment will obviously depend on the arc length of the arcuate slot 1230. While a single example of how angular motion of the hub assembly 127 is limited is provided for illustrative purposes, it is to be understood that the example provided is by no means limiting of the manner in which said angular motion can be limited, and that the more important overall concept is that the pivot range of the hub assembly 127 can be limited to within a predetermined angular range by any suitable means.

Figure 8:
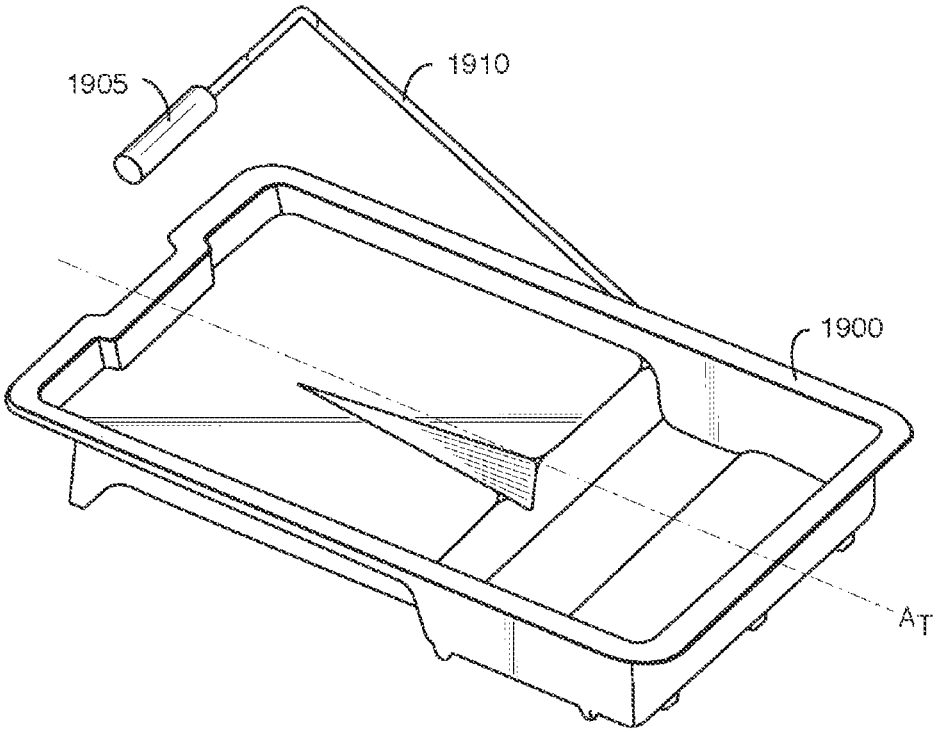
FIG. 8 is a perspective view of an illustrative paint tray with an associated carrying grip and handle.
Figure 9:
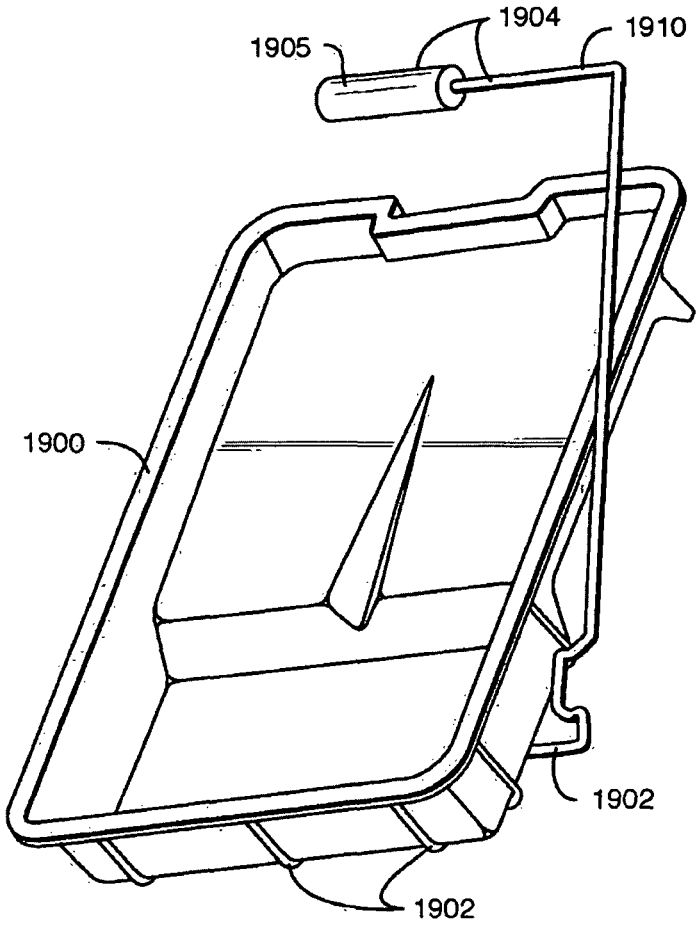
FIG. 9 is an alternative view of the paint tray of FIG. 9.
Figure 10:
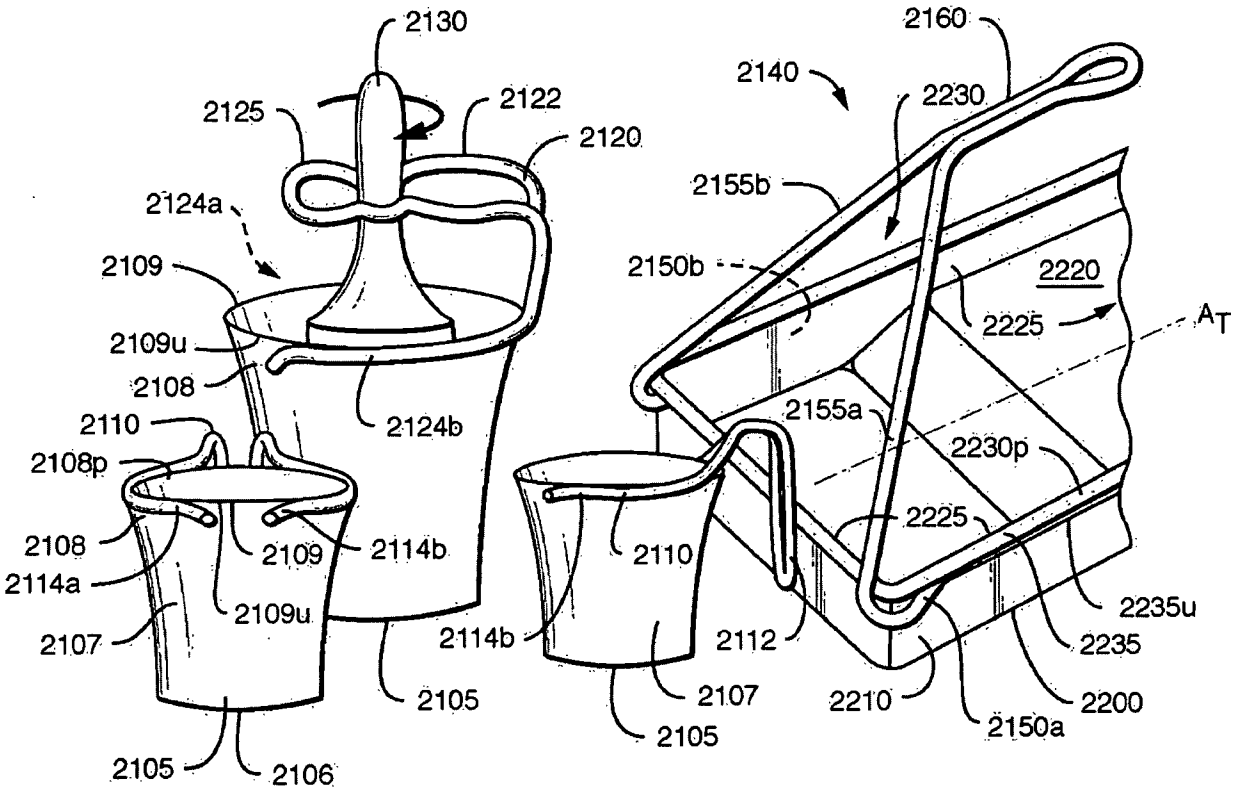
FIG. 10 depicts various paint containers (e.g., trays, cans or pails) with variously configured grip and handle structures associated therewith.

With reference to FIGS. 8 through 10, variously configured paint trays with carrying grips and handles suitable for use in conjunction with the universal paint applicator 100 are shown and briefly described. FIGS. 8 and 9 illustrate perspective views of an example paint tray 1900 with a grip 1905 depending from a handle 1910. The grip 1905 allows the user to easily grasp, manipulate and relocate the tray 1900 without touching the tray 1900 itself. In this manner, the user need not get messy with paint. The handle 1910 is angled relative to the tray 1900 so that the paint applicator 100 can be easily dipped or rolled in the paint (not shown) contained within the tray 1900.

FIG. 10 depicts various paint containers 2105 (e.g., trays, cans or pails) with variously configured grip and handle structures associated therewith. In one embodiment, a handle 2110 engages the container 2105 at or near a lip 2115 of the container 2105, thereby providing reliable gripping of the container 2105 without the need to directly touch the container 2105. In another embodiment, a handle 2120 provides a similar engagement with the container 2105, but also includes a paint brush handle holder portion 2125, which allows a paint brush handle 2130 to stand upright within the container 2105. The paint brush handle 2130 can be twisted in an upright position to soak up paint into its brush. In yet another embodiment, a handle 2135 can be adapted to fit the paint tray 2105. The handle 2135 can engage multiple side lips 2140 of the paint tray 2105. In this manner, a user can lift and move the paint containers 2105 without directly coming into contact with the containers 2105, thereby maintaining a cleaner work environment.

The foregoing is considered to be illustrative of the principles of the invention. Furthermore, since modifications and changes to various aspects and implementations will occur to those skilled in the art without departing from the scope and spirit of the invention, it is to be understood that the foregoing does not limit the invention as expressed in the appended claims to the exact constructions, implementations and versions shown and described.

What is claimed is:

1. A universal paint applicator configured for use in combination with a roller cover including a cylindrical roller-cover core with an inside surface and an outside surface carrying an absorbent material for alternatively absorbing and depositing paint on a surface, the applicator comprising:

a handle assembly that extends longitudinally along a handle axis;

first and second pivot arm assemblies carried by, and extending forwardly of, the handle assembly such that the pivot arms are disposed symmetrically about the handle axis, each pivot arm assembly including a pivot arm having a proximate end by which it depends from the handle assembly for rotation about a pivot arm axis and a distal end opposite the proximate end and disposed forwardly of the handle assembly;

a bi-directional pivot arm actuator carried by the handle and cooperatively linked to each pivot arm assembly such that movement of the actuator in a first direction causes the pivot arms to rotate toward one another and movement of the actuator in a second direction, opposite the first direction, causes the pivot arm assemblies to rotate away from one another; and a hub assembly pivotably coupled to the distal end of each of the first and second pivot arms for angular movement about a hub-pivot axis, each hub assembly including a hub axle and a hub mounted for rotation on the hub axle about a hub-rotation axis defined by the hub axle, each hub including an outer surface configured to frictionally engage the inside surface of the roller-cover core such that the hubs of the first and second pivot arms cooperate to retain the roller cover between the pivot arms; wherein the hub-rotation axes, hub-pivot axes and pivot arm axes are movable into disparate mutual orientations such that, when the pivot arms are spread to various degrees, the hub-rotation axes can be aligned to define a common roller-cover rotation axis so that the roller cover cooperatively retained by the hubs can be of any length between a predetermined minimum length and a predetermined maximum length.

2. A universal paint applicator configured for use in combination with a roller cover including a cylindrical roller-cover core with an inside surface and an outside surface carrying an absorbent material for alternatively absorbing and depositing paint on a surface, the applicator comprising:

a handle assembly that extends longitudinally along a handle axis;

first and second pivot arm assemblies carried by, and extending forwardly of, the handle assembly such that the pivot arms are disposed symmetrically about the handle axis, each pivot arm assembly including a pivot arm having a proximate end by which it depends from the handle assembly for rotation about a pivot arm axis and a distal end opposite the proximate end and disposed forwardly of the handle assembly;

a bi-directional pivot arm actuator carried by the handle and cooperatively linked to each pivot arm assembly such that movement of the actuator in a first direction causes the pivot arms to rotate toward one another and movement of the actuator in a second direction, opposite the first direction, causes the pivot arm assemblies to rotate away from one another; and a hub assembly pivotably coupled to the distal end of each of the first and second pivot arms for angular movement about a hub-pivot axis, each hub assembly including a hub axle and a hub mounted for rotation on the hub axle about a hub-rotation axis defined by the hub axle, each hub including an outer surface configured to frictionally engage the inside surface of the roller-cover core such that the hubs of the first and second pivot arms cooperate to retain the roller cover between the pivot arms; wherein (i) the hub-rotation axes, hub-pivot axes and pivot arm axes are movable into disparate mutual orientations such that, when the pivot arms are spread to various degrees, the hub-rotation axes can be aligned to define a common roller-cover rotation axis so that the roller cover cooperatively retained by the hubs can be of any length between a predetermined minimum length and a predetermined maximum length;

(ii) each pivot arm assembly further includes at the proximate end of each pivot arm a pivot arm gear having pivot-gear teeth; and (iii) the pivot arm actuator comprises a worm-drive shaft carrying a worm gear with teeth that intermesh with the pivot-gear teeth of each pivot arm such that rotation of the worm-drive shaft in a first direction causes the pivot arms to rotate about their pivot arm axes inwardly toward one another and rotation of the worm-drive shaft in a second direction opposite the first direction causes the pivot arms to mutually spread in an outwardly direction thereby facilitating, respectively, engagement and disengagement of the outer surfaces of the hubs with the inside surface of the roller-cover core.

3. A universal paint applicator configured for use in combination with a roller cover including a cylindrical roller-cover core with an inside surface and an outside surface carrying an absorbent material for alternatively absorbing and depositing paint on a surface, the applicator comprising:

a handle assembly that extends longitudinally along a handle axis;

first and second pivot arm assemblies carried by, and extending forwardly of, the handle assembly such that the pivot arms are disposed symmetrically about the handle axis, each pivot arm assembly including a pivot arm having a proximate end by which it depends from the handle assembly for rotation about a pivot arm axis and a distal end opposite the proximate end and disposed forwardly of the handle assembly;

a bi-directional pivot arm actuator carried by the handle and cooperatively linked to each pivot arm assembly such that movement of the actuator in a first direction causes the pivot arms to rotate toward one another and movement of the actuator in a second direction, opposite the first direction, causes the pivot arm assemblies to rotate away from one another; and a hub assembly pivotably coupled to the distal end of each of the first and second pivot arms for angular movement about a hub-pivot axis, each hub assembly including a hub axle and a hub mounted for rotation on the hub axle about a hub-rotation axis defined by the hub axle, each hub including an outer surface configured to frictionally engage the inside surface of the roller-cover core such that the hubs of the first and second pivot arms cooperate to retain the roller cover between the pivot arms; wherein (i) the hub-rotation axes, hub-pivot axes and pivot arm axes are movable into disparate mutual orientations such that, when the pivot arms are spread to various degrees, the hub-rotation axes can be aligned to define a common roller-cover rotation axis so that the roller cover cooperatively retained by the hubs can be of any length between a predetermined minimum length and a predetermined maximum length;

(ii) each of the first and second pivot arm assemblies further includes at the proximate end of its respective pivot arm a pivot arm gear having pivot-gear teeth; and (iii) the pivot-gear teeth of the first pivot arm assembly are directly intermeshed with the pivot-gear teeth of the second pivot arm assembly such that the rotation of one of the pivot arms in one of an inwardly and outwardly direction causes the rotation of the other pivot arm in, respectively, an inwardly and outwardly direction with respect to the handle axis, each pivot arm thereby serving as the bi-directional pivot arm actuator for the other pivot arm.

* * * * *